US010220265B2

(12) United States Patent
Feeley

(10) Patent No.: US 10,220,265 B2
(45) Date of Patent: Mar. 5, 2019

(54) METALLIZED AND MASKED GOLF BALL AND METHOD

(71) Applicant: John F Feeley, Saint Petersburg, FL (US)

(72) Inventor: John F Feeley, Saint Petersburg, FL (US)

( * ) Notice: Subject to any disclaimer, the term of this patent is extended or adjusted under 35 U.S.C. 154(b) by 0 days.

(21) Appl. No.: 15/694,050

(22) Filed: Sep. 1, 2017

(65) Prior Publication Data

US 2017/0361175 A1 Dec. 21, 2017

Related U.S. Application Data

(62) Division of application No. 15/209,914, filed on Jul. 14, 2016, now Pat. No. 9,776,049.

(60) Provisional application No. 62/192,417, filed on Jul. 14, 2015.

(51) Int. Cl.

| | |
|---|---|
| ***A63B 45/02*** | (2006.01) |
| ***A63B 37/00*** | (2006.01) |
| ***A63B 45/00*** | (2006.01) |

(52) U.S. Cl.

CPC ..... *A63B 45/00* (2013.01); *A63B 37/0022* (2013.01); *A63B 45/02* (2013.01); *A63B 2209/00* (2013.01)

(58) Field of Classification Search

CPC ..... A63B 45/02

See application file for complete search history.

(56) References Cited

U.S. PATENT DOCUMENTS

| | | | | |
|---|---|---|---|---|
| 7,922,607 | B2 | 4/2011 | Morgan et al. | |
| 8,758,168 | B2 | 6/2014 | Morgan et al. | |
| 2002/0010037 | A1* | 1/2002 | Nesbitt | A63B 37/0003 473/371 |
| 2011/0224024 | A1* | 9/2011 | Tutmark | A63B 37/0022 473/378 |
| 2014/0018187 | A1 | 1/2014 | Lin | |
| 2014/0066229 | A1 | 3/2014 | Kuntimaddi | |
| 2015/0165277 | A1* | 6/2015 | Ono | A63B 45/00 264/400 |

* cited by examiner

*Primary Examiner* — Xiao S Zhao

(74) *Attorney, Agent, or Firm* — Tredecim LLC; Sean L. Sweeney; Taylor A. Noonan

(57) ABSTRACT

The present invention is directed to a metallized golf ball possessing a masked section and methods for achieving a metallized golf ball possessing a masked section. The invention provides a golf ball masking stand, which effectively masks a portion of a golf ball, allowing coatings to be applied to the golf ball, while preventing coating of the masked section. Alternative masking techniques are disclosed, including the use of labels, double-stick tape, and printing methods to create a masked section. Preferably, metallization of the golf ball is achieved using physical vapor deposition and preferably a hydrophobic protective coating is applied to the metal layer inside the metallizing chamber.

4 Claims, 2 Drawing Sheets

METALLIZED AND MASKED GOLF BALL AND METHOD

CROSS-REFERENCE TO RELATED APPLICATION

This application is a division of and claims priority to U.S. application Ser. No. 15/209,914, filed on Jul. 14, 2016, which claims the benefit of U.S. Provisional Patent Application No. 62/192,417, filed on Jul. 14, 2015, the disclosures of which are herein incorporated by reference.

BACKGROUND

1. Field of the Invention

The present invention pertains to the field of golf balls and in one embodiment to a metallized golf ball, where a specified portion of the golf ball remains uncoated, facilitating the ability to apply after-market text, images, and logos to the metallized ball.

2. Discussion of Background Information

Current golf ball technology typically utilizes a central core that is either solid or wound. Commonly, this core is over-molded with a durable outer coating, such as an ionomer resin, polyurethane or other suitable cover material. One example of a commercially available ionomer resin used for outer coatings on golfs balls is SURLYN® from E.I. DuPont de Nemours and Co. of Wilmington, Del.

The outer coating provides durability and as is well-known usually includes dimples or other aerodynamic contouring. Text or images placed on the ball by the manufacturer are conventionally printed directly on the outer coating and then over-coated with a clear lacquer to improve the durability of the printing during normal wear and tear associated with use. In order to apply the lacquer layer, golf ball manufacturers traditionally utilize a pin arrangement as is known in the art to hold the balls while the lacquer is applied. Traditionally, three pins are used to support the ball. During the lacquering process, the pins leave a small mark that is usually not visible to consumers. However, as the lacquer builds up, the mark left by the pins gets larger, which necessitates regular cleaning of the pins.

A high percentage of golf balls have special logos in addition to the text or images placed on the balls by the manufacturer. These special logos are commonly added after the ball is manufactured. As a result, although manufacturers have the luxury of placing text and images under the lacquer coat, these custom, after-market logos are generally printed on top of the clear lacquer. Printing on the outer surface of the golf ball has inherent problems, not the least of which is that coloration of the golf ball can obscure the printed text or logos. In addition, some coatings, such as hydrophobic protective coatings, are incompatible with printing.

Numerous patents and published applications address golf ball decorations, with most of these references involving technologies developed by golf ball manufacturers related to printing techniques. In addition, the prior art includes the disclose of decorative layers, including decorative metal layers, applied on top of the core and beneath the outer coating.

The majority of golf balls are white. These white golf balls are traditionally produced by using a white pigmented outer coating material that is over-coated with a clear lacquer. Where it is desirable to produce a colored ball, the preferred method is to add pigment to the outer coating in order to achieve the desired color and then add the clear lacquer coat. However, in less expensive, low-end balls, such as balls for use in mini-golf or at driving ranges, some balls achieve a custom color by simply pigmenting the lacquer coat, while others add an additional color layer on top of the outer coating and then finish the ball with a clear lacquer coat.

In addition to colored golf balls, there is a demand for golf balls with a metallic appearance. Technologies for metallizing items are well known. One common means of metallizing items utilizes physical vapor deposition (PVD). PVD encompasses several methods for metal layer deposition, including sputtering, evaporation, cathodic arc deposition and others. For clarity, it is expressly understood that where the term "metal" is used, the term encompasses true metals and metallic compounds, such as TixNy, ITO, AlxOy, SixOy, and SixNy, known to one of skill in the art to be applied via PVD. Another common means of metallizing items utilizes a spray-on technique known as silver reduction. Silver reduction is most commonly used to produce mirrors but can be used to coat three dimensional items such as plastic caps or golf balls.

However, there are significant challenges to using PVD to impart a metallic appearance to a golf ball. One method known in the art for creating a metallic appearance, disclosed in U.S. Publication No. 20140018187, applies a thin aluminum layer to the core of the golf ball. The metallized core is subsequently coated with a clear outer coating. Text and images can easily be printed on this three-layer ball and a lacquer coat is traditionally applied over the printing. The benefit of this approach is that the metal layer is protected from the wear associated with use of the golf ball, preventing scraping, scratching and pealing of the metal layer as the ball is struck by a golf club. However, this approach has several disadvantages. First, the metal coating is dulled significantly because it is placed beneath the outer coating and, second, because the metal is applied to the smooth core, the ball coating has a flatter appearance.

In contrast, when the metal layer is applied on top of the outer coating, the metal follows the contours of the ball surface, creating a textured appearance that resembles a disco ball. One significant concern when a metal layer is applied to the exterior of a golf ball, however, is that the metal can easily tarnish in the time it takes for the ball to reach the consumer. In addition, adding a hydrophobic topcoat, which can be applied in conjunction with the metallization process, makes it difficult to add text or images to the ball after processing. Because none of the above existing devices, methods and systems, taken either singly or in combination, adequately address or resolve the aforementioned problems, a need exists for a metallic-appearance golf ball and method that facilitates the addition of text and imagery after processing and that retains the high luster and contoured appearance of a traditional golf ball.

SUMMARY OF THE INVENTION

The present invention solves the problems associated with metallizing golf balls, while simultaneous facilitating the ability to apply after-market text and logos to the metallized ball.

BRIEF DESCRIPTION OF THE DRAWINGS

These and other features, aspects and advantages of the present invention will become better understood with reference to the following description, appended claims, and accompanying drawings where:

DETAILED DESCRIPTION OF THE INVENTION

The golf balls of the present invention possess a metallized outer layer, but retain the ability to apply text and images such as logos to the surface of the ball. Specifically, the present invention provides for a pre-defined section of the golf ball to remain free from metallization and top coating, creating an opportunity for the application of text and images after the metallization process is complete.

The present invention solves the problems associated with imparting a golf ball with a metallic appearance, while simultaneously facilitating the post-production application of text, images, and logos.

The present invention is directed to a metallized golf ball, where a golf ball is metallized, but a specific portion of the ball is left unprocessed, leaving a portion of the ball for the traditional post-production application of text and images. The metallized golf balls of the present invention are processed such that a specified portion, preferably a circular portion of the ball, is not metallized and does not receive an overcoat.

The present invention is also related to a novel golf ball masking stand for masking a portion of golf ball during processing. The golf ball masking device utilizes a series of support pins to support the ball atop a central masking support. In addition, the masking support protects a desired portion of the golf ball, masking it as decorative coatings and topcoats are applied to outer surface of the ball.

The present invention is also directed to a method of metallizing a golf ball. First, the method comprises providing a golf ball processing stand, which is comprised of a series of pins surrounding a shielding cup. The ball and stand are then placed into the chamber of a metallizer and a metal layer is applied using PVD, preferably sputtering. In some embodiments, a hydrophobic top coat is further deposited in the metallizer chamber to prevent tarnishing of the metal layer and to improve durability.

Figure 1:
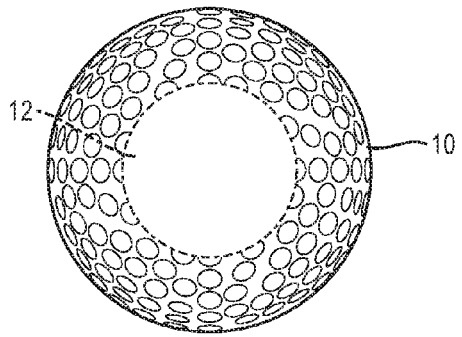
FIG. 1 shows a front view of a metallized golf ball of the present invention, where a portion of the ball has been masked.

Turning to FIG. 1, a metallized golf ball 10 of the present invention is shown. While the vast majority of the golf ball 10 is coated with metal, the golf ball 10 includes a masked section 12, which is masked during the metallization process, preserving a portion of the golf ball 10 for the application of a logo after the metallization is complete. The color of the metallized golf ball 10 can be easily adjusted by selecting different metals. For example, depositing aluminum results in a silver colored golf ball 10, while depositing copper results in a copper or bronze coloring. In addition, a gold color can be achieved by depositing one of the copper alloys known in the art.

An alternate processing sequence would be to apply the text, image, or logo before the metallization process. The disadvantage of this method is that it is difficult to center the artwork or image inside the masking section 12. If this alternate sequence is used it is more likely that a removable printed or label mask be applied over the logo prior to metallization as described below.

A significant benefit of depositing metal onto the outer surface of the golf ball 10 is that the coloration is not muted or masked by the plastic layer. In addition, because the metal is applied to the contoured surface of the golf ball 10, the resulting metallized golf ball 10 retains the contoured appearance of a traditional golf ball 10 and even takes on a disco ball appearance due to the contours in the reflective metal surface.

In addition to the metal layer, a hydrophobic coating is preferably applied in the metallization chamber as part of the metallization process. This hydrophobic coating is applied after the metal layer and prevents tarnishing and improves durability of the metal layer. Although hydrophobic coatings are notoriously difficult to print onto, because the masked section 12 remains unprocessed and, therefore, does not receive either a metal layer or a hydrophobic coating, text and images can easily be added to the masked section 12 even though a hydrophobic coating is applied to protect the metal layer.

Figure 2A:
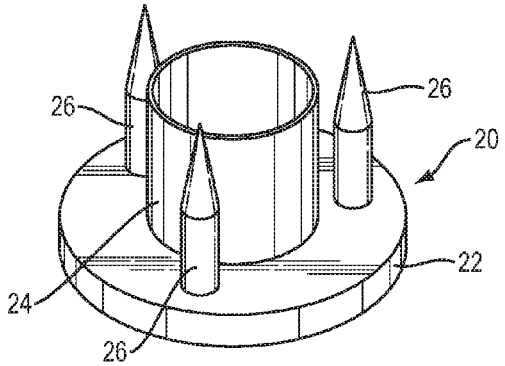
FIG. 2A shows a perspective view of a golf ball masking stand of the present invention.
Figure 2B:
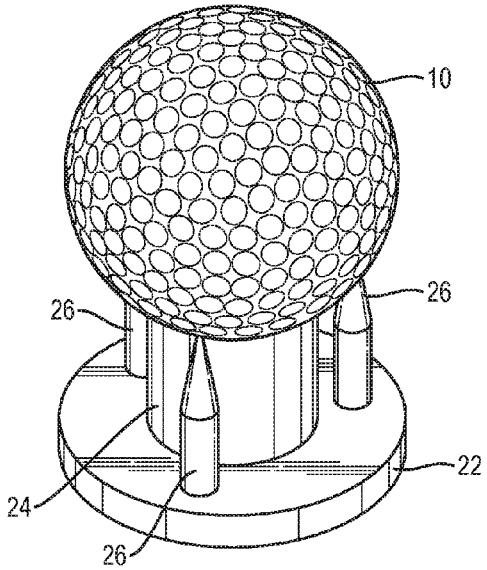
FIG. 2B shows a perspective view of a golf ball positioned on a golf ball masking stand of the present invention holding a golf ball.

Turning to FIGS. 2A and 2B, a golf ball masking stand 20 of the present invention is shown, with and without a golf ball 10 positioned in the golf ball masking stand 20. As depicted, the golf ball masking stand 20 is comprised of three support pins 26 and a masking support 24 positioned on a substantially planar base 22. The masking support 24 is sized according to the desired masking size and can range from a diameter of about 0.25 inches to about 1.7 inches, and preferably from about 0.7 inches to 1.25 inches. Anything smaller than about 0.25 inches and the golf ball 10 becomes unstable in the masking support 24, and anything larger that about 1.7 inches and the golf ball 10 would slip into the masking support 24 because the diameter of the masking support 24 would exceed the diameter of the golf ball 10.

The masking support 24 is preferably made of metal, although it could be made from silicone, rubber, plastic, nylon or other suitable materials known in the art. The masking support 24 is preferably cylindrical. However, in some embodiments of the present invention, the masking support 24 may deviate from the cylindrical shape based on the desired shape of the masked section 12. Regardless of the shape of the masking support 24, it is important that the golf ball 10 sit substantially flush against the top of the masking support 24 to ensure that the desired masking occurs.

Where the masking support 24 is a made from a compliant material, such as silicone, the masking support 24 may use a suction cup design to mask and hold the golf ball 10. Indeed, in some circumstances, the suction cup may obviate the need for additional support pins 26. However, due to the use of a vacuum during the sputtering process, it is preferred that the golf ball masking stand 20 incorporate support pins 26 to ensure adequate handling of the golf ball 10 during the metallization process, The support pins 26 are positioned in a manner that provides additional stability to the golf ball 10 while the ball is supported on the golf ball masking stand 20. In addition, as depicted in FIG. 2B, the support pins 26 should permit the golf ball 10 to remain substantially flush against the masking support 24 to facilitate the masking function of the golf ball masking stand 20. Although the support pins 26 may be placed in any position that supports the golf ball 10 in the desired position atop the masking support 24, preferably the support pins 26 are placed just outside the masking support 24 as depicted in FIGS. 2A and 2B. Although not depicted in the figures, a further preferable location for the support pins 26 is just inside the outer edge of the masking support 24.

Other methods for achieving a masked section 12 are possible without deviating from the scope of the present invention. For example, labels or double-sided tape may be adhered to the golf ball 10 prior to metallization. In this embodiment, the golf ball 10 is supported by a traditional ball stand, which includes support pins 26, but not a masking support 24. The entire golf ball 10 is metallized and a hydrophobic protective coating is applied, and the label or tape is then removed post-processing to reveal a masked section 12 of the golf ball. Labels and other adhesive masking devices have the benefit of more easily permitting different mask geometries and may be preferable in some instances.

Alternatively, instead of a label or tape, the masked section 12 may be created by printing, such as pad printing or digital printing, with an ink that has a poor adhesion to the golf ball. Once the masked section is printed on the ball, the ball is placed on a traditional ball support, which includes support pins 26, but not a masking support 24, and the metal layer and a hydrophobic coating are applied to the entire golf ball 10. After metallization and top-coating, the portion of the metal layer and hydrophobic coating applied to the printed spot can be peeled off the golf ball 10 to reveal a masked section 12 suitable for printing text and images.

The metal layer is preferably applied by sputtering due to several advantages of this technique. Not only does sputtering reliably apply the metal layer to the golf ball 10, but the sputtering process, which applies a very thin metal layer, significantly reduces the amount of buildup that accumulates on the golf ball masking stand 20 as compared to painting or lacquering. Even coating of the golf ball 10 during the metallization process can be obtained by implementing a double planetary rotatory jig inside the metallization chamber. However, systems implementing a single planetary rotatory process may also be used to achieve satisfactory results. Another benefit of the very thin metal layer is that the metal is flexible. If a thicker layer of metal was applied it could impair the ability of the golf ball 10 to compress when struck by a golf club. A thicker layer of metal would be more prone to cracking or denting as well.

As will be understood by one of skill in the art, the present invention is not limited to metallized golf balls. Indeed, in many instances, it is advantageous to create a masked section 12 during the painting process in order to facilitate the post-painting addition of text and images. For example, where a golf ball 10 is painted in a dark color, text and images placed over the paint can be very difficult to see. In one embodiment of the present invention, a majority of a golf ball 10 is painted and a masked section 12 is left unpainted, providing a portion of the golf ball 10 suitable for adding text or images after the paint is applied. In this embodiment, the resulting golf ball 10 will have an appearance similar to the metallized ball depicted in FIG. 1, where a masked section 12 allows for the application of text or images after the golf ball 10 is decorated. As described above, the masked section 12 can be achieved by using a golf ball masking stand 20, by using labels or double-sided tape, or by using printing techniques, such as pad or digital printing.

The golf ball masking stand 20 of the present invention can be used to mask a golf ball 10 during the painting process in a similar manner to the way that the golf ball masking stand 20 masks a metallized golf ball 10. Specifically, the golf ball masking stand 20 could be incorporated into a painting line to mask a specific portion of the ball from the painting process, creating a masked section 12 suitable for printing text and graphics.

Figure 3:
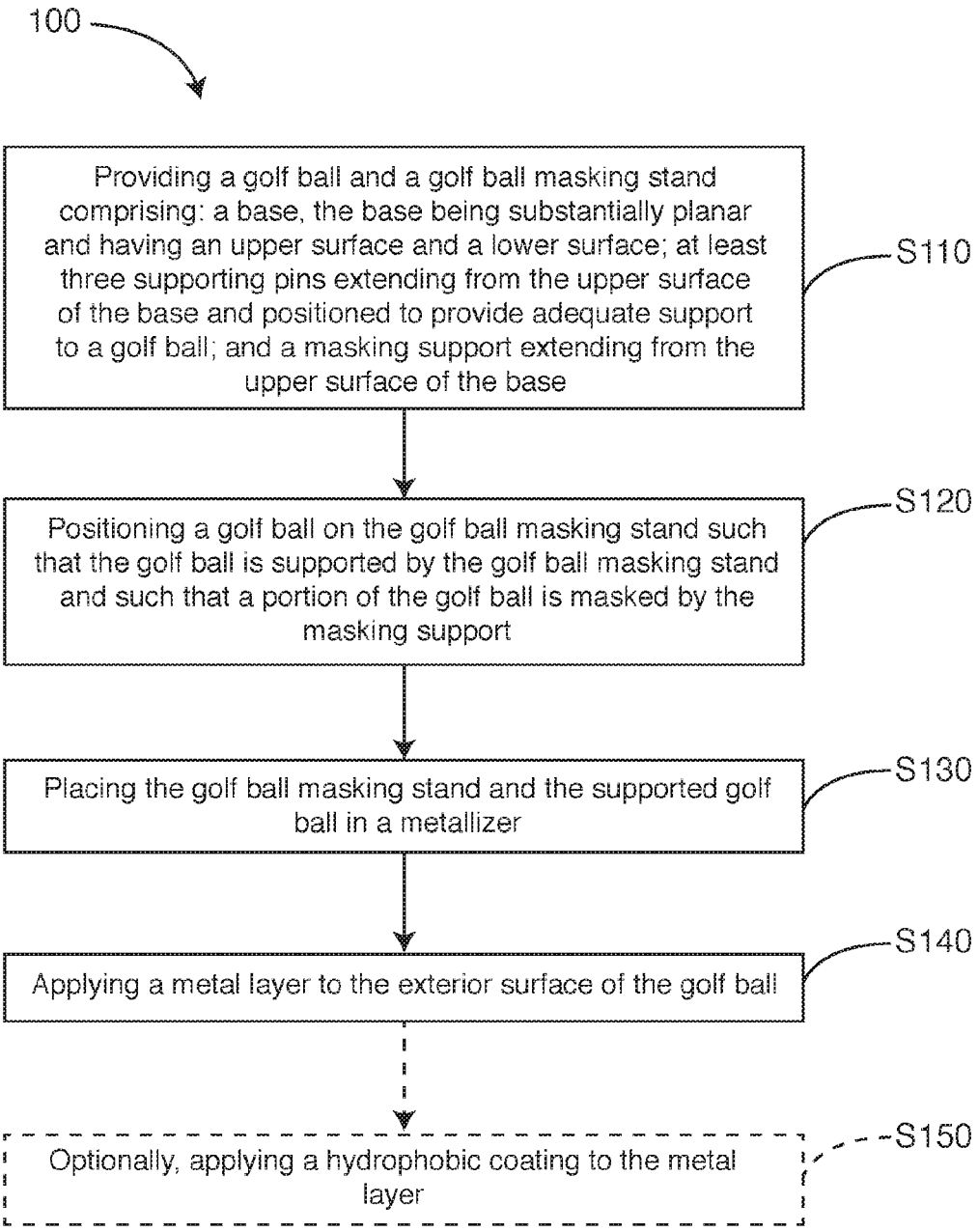
FIG. 3 shows the steps of a method of the present invention.

Turning to FIG. 3, a method 100 of the present invention for metallizing a golf ball is depicted. The method 100 comprises a first step S110 of providing a golf ball and a golf ball masking stand 20 comprising a base 22, the base 22 being substantially planar and having an upper surface and a lower surface; at least three supporting pins 26 extending from the upper surface of the base 22 and positioned to provide adequate support to the golf ball 10; and a masking support 24 extending from the upper surface of the base 22. A second step S120 involves positioning the golf ball 10 on the golf ball masking stand 20 such that the golf ball 10 is supported by the golf ball masking stand 20 and such that a portion of the golf ball 10 is masked by the masking support 24. A third step S130 involves placing the golf ball masking stand 20 and the supported golf ball 10 in a metallizer. A fourth step S140 involves applying a metal layer to the exterior surface of the golf ball 10. Optionally, a fifth step S150 involves applying a hydrophobic coating to the metal layer.

When performing the metallization inside the chamber of a metallizer, a single or a double planetary rotatory jig may be used to rotate the golf ball 10 during the metallizing process and when applying the optional hydrophobic top coat. As discussed in connection with masking alternatives, the process described above may be altered to utilize labels, tape, or printing to generate the masked section 12. Where these alternative masking means are employed, step S110 can be amended such that the provided golf ball masking stand 20 does not include the masking support 24.

Another method besides PVD to apply thin coatings to plastic substrates is known as silver reduction. This is done by properly preparing the plastic surface, applying a reactive aqueous silver nitrate solution, then rinsing with deionized water. Besides the higher material costs as compared with PVD, it is difficult to prevent the wetted aqueous solution from getting under the masking support 24 of the golf ball masking stand 20. If silver reduction where to be used to metallize the golf ball 10, one of the alternate masking methods such as removable labels or printing would likely be utilized.

An alternate to using a hydrophobic coating applied in the PVD chamber would be to apply a transparent lacquer similar to what is used by golf ball manufactures. These lacquers are much thicker than in-chamber physical vapor deposition or chemical vapor deposition coatings and are typically sprayed on, but alternate application methods such as dipping or flow coating are feasible. This method, if used with proper materials and processes, provides better mechanical and environmental protection as compared with the thin metal in-chamber coatings. The disadvantage is the additional process steps and costs associated with these lacquer coating methods. Another advantage to applying the thicker lacquers is that they can be tinted to produce other metallic colors such as blues, greens, reds, and pinks; darker colors such as pewter and gun-metal; and other special effects pigments such as pearlescent, metallic, and matting agents to modify gloss levels and surface texture.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation.

Although the present invention has been described herein with reference to particular means, materials and embodiments, the present invention is not intended to be limited to the particulars disclosed herein; rather, the present invention extends to all functionally equivalent structures, methods and uses.

What is claimed is:

1. A metallized golf ball comprising:

a. a golf ball comprising a central core surrounded by a cover material;

b. a layer of metal applied to the exterior of the cover material;

c. a hydrophobic protective coating applied to the layer of metal; and d. a masked section of the cover material that does not include either the layer of metal or the hydrophobic coating.

2. The metallized golf ball of claim 1 wherein the masked section is substantially round.

3. The metallized golf ball of claim 1 wherein the layer of metal applied to the exterior of the cover material is aluminum.

4. The metallized golf ball of claim 1 wherein the layer of metal applied to the exterior of the cover material is copper or a copper alloy.

* * * * *